US011226148B2

(12) United States Patent
Cheng et al.

(10) Patent No.: US 11,226,148 B2
(45) Date of Patent: Jan. 18, 2022

(54) REFRIGERATOR

(71) Applicant: HISENSE RONSHEN (GUANGDONG) REFRIGERATOR CO., LTD., Guangdong (CN)

(72) Inventors: Zhonghai Cheng, Guangdong (CN); Minwei Tan, Guangdong (CN); Jiawei Zhu, Guangdong (CN); Weihao Xie, Guangdong (CN); Yang Zhang, Guangdong (CN)

(73) Assignee: Hisense Ronshen (Guangdong) Refrigerator Co., Ltd., Guangdong (CN)

( * ) Notice: Subject to any disclaimer, the term of this patent is extended or adjusted under 35 U.S.C. 154(b) by 105 days.

(21) Appl. No.: 16/720,889

(22) Filed: Dec. 19, 2019

(65) Prior Publication Data

US 2020/0124339 A1 Apr. 23, 2020

Related U.S. Application Data

(63) Continuation of application No. PCT/CN2018/089824, filed on Jun. 4, 2018.

(30) Foreign Application Priority Data

Jun. 19, 2017 (CN) ..... 201710465174.9

(51) Int. Cl.
*F25D 17/06* (2006.01)
*F25D 11/02* (2006.01)
*F25D 17/08* (2006.01)

(52) U.S. Cl.
CPC ..... *F25D 17/065* (2013.01); *F25D 11/02* (2013.01); *F25D 17/067* (2013.01); *F25D 17/08* (2013.01)

(58) Field of Classification Search
CPC ..... F25D 17/065; F25D 11/02; F25D 17/067; F25D 17/08; F25D 2317/063; F25D 2317/067; F25D 11/00; F25D 17/062
(Continued)

(56) References Cited

U.S. PATENT DOCUMENTS 7,866,182 B2 * 1/2011 Lim ..... F25D 17/067 62/418
2010/0307065 A1 12/2010 Eckartsberg
2013/0086936 A1 4/2013 Choi et al.

FOREIGN PATENT DOCUMENTS

CN 102435036 A 5/2012
CN 102564009 A 7/2012
(Continued)

OTHER PUBLICATIONS

Notice of Reasons for Refusal for Japanese Application No. 2019-570054 dated Dec. 21, 2020 (with English translation) (16 pp.).
(Continued)

*Primary Examiner* — Ana M Vazquez
(74) *Attorney, Agent, or Firm* — Crowell & Moring LLP

(57) ABSTRACT

A refrigerator may include an air duct cover plate, a closed air cavity, an evaporator, and an air guiding rib. The air duct cover plate and a liner of the refrigerator enclose the closed air cavity. The evaporator is disposed on an outer surface of the liner. The air guiding rib is disposed in the closed air cavity. The air guiding rib divides the closed air cavity into an air intake region, a first supply region, and a second supply region that are sequentially in fluid communication. The first supply region is located above the air intake region and includes an upper air outlet. The second supply region is located below the first supply region and is separated from the air intake region by the air guiding rib. A lower air outlet is disposed in the second supply region.

18 Claims, 6 Drawing Sheets

(58) Field of Classification Search
USPC ..... 62/419
See application file for complete search history.

(56) References Cited

FOREIGN PATENT DOCUMENTS

| | | | | | |
|---|---|---|---|---|---|
| CN | 203704497 | U | | 7/2014 | |
| CN | 104048468 | A | * | 9/2014 | ..... F25D 17/04 |
| CN | 104048468 | A | | 9/2014 | |
| CN | 104879987 | A | | 9/2015 | |
| CN | 105157311 | A | | 12/2015 | |
| CN | 105157318 | A | | 12/2015 | |
| CN | 105546918 | A | | 5/2016 | |
| CN | 105605859 | A | | 5/2016 | |
| CN | 106524653 | A | | 3/2017 | |
| CN | 206113484 | U | | 4/2017 | |
| CN | 107036639 | A | | 8/2017 | |
| EP | 2 317 257 | A1 | | 5/2011 | |
| EP | 2 568 239 | A2 | | 3/2013 | |
| EP | 2 592 372 | A2 | | 5/2013 | |
| JP | H 5-52460 | A | | 3/1993 | |
| JP | H 6-117744 | A | | 4/1994 | |
| JP | H 7-146050 | A | | 6/1995 | |
| JP | H 7-253268 | A | | 10/1995 | |
| JP | H 8-75338 | A | | 3/1996 | |
| JP | H 8-200509 | A | | 8/1996 | |
| JP | 2002-295948 | A | | 10/2002 | |
| JP | 2005-134043 | | | 5/2005 | |
| JP | 2013-204891 | A | | 10/2013 | |
| JP | 2014-137160 | A | | 7/2014 | |
| KR | 10-2014-0075277 | | | 6/2014 | |
| KR | 10-2016-0012517 | A | | 2/2016 | |
| WO | WO 2013/054785 | A1 | | 4/2013 | |
| WO | WO 2013/135149 | A1 | | 9/2013 | |
| WO | WO 2015/035863 | A1 | | 3/2015 | |

OTHER PUBLICATIONS

Reasons for Refusal for Japanese Application No. 2019-570054 dated Jan. 4, 2021 (with English translation) (16 pp.). Please note this date was incorrectly listed as Dec. 21, 2020 on Applicants' First Supplemental IDS filed on Feb. 22, 2021.

International Search Report and Written Opinion of the International Search Authority dated Aug. 20, 2018 in International Application No. PCT/CN2018/089824 (English and German languages) (12 pp.).

First Office Action received from the State Intellectual Property Office of People's Republic of China for Application No. 201710465174.9 dated Mar. 1, 2019 (with English translation) (14 pp.).

Refusal Decision received from the State Intellectual Property Office of People's Republic of China for Application No. 201710465174.9 dated Aug. 20, 2019 (with English translation) (7 pp.).

Extended European Search Report for EP Application No. EP 18820974.6 dated Mar. 9, 2021 (7 pages).

* cited by examiner

REFRIGERATOR

CROSS-REFERENCE TO RELATED APPLICATION

This application is a Bypass Continuation Application of PCT/CN2018/089824, filed Jun. 4, 2018, and claims priority to Chinese Patent Application No. 201710465174.9, filed with the Chinese Patent Office on Jun. 19, 2017, titled "REFRIGERATOR AIR SUPPLY SYSTEM AND AIR-COOLED REFRIGERATOR". All applications listed in this paragraph are hereby incorporated by reference in their entireties.

TECHNICAL FIELD

The present disclosure relates to the field of refrigerators.

BACKGROUND

At present, with a widespread application of air-cooled refrigerators, the air-cooled refrigerators are increasingly favored by consumers. A refrigeration principle of the air-cooled refrigerators is to use circulating air to perform refrigeration. When air with a high temperature flows through a built-in evaporator, the air directly exchanges heat with the evaporator, and the temperature of the air is lowered. Cold air formed after the heat exchange is blown into the air-cooled refrigerator, thereby a temperature of the air-cooled refrigerator is reduced. How to improve a refrigeration effect of the air-cooled refrigerators has become a focus of research and development of the air-cooled refrigerators.

SUMMARY

Some embodiments of the present disclosure provide a refrigerator. The refrigerator includes a cabinet including a chamber. The cabinet includes: a housing, a liner, and an air duct cover plate; a closed air cavity formed at least partially between the air duct cover plate and the liner; an evaporator disposed between the liner and the housing, and wherein an orthographic projection of the evaporator on the liner at least partially overlaps with an orthographic projection of the closed air cavity on the liner; and an air guiding rib disposed in the closed air cavity and dividing the closed air cavity into an air intake region, a first air supply region and a second air supply region that are sequentially in fluid communication. The cabinet also includes an air inlet, an upper air outlet and a lower air outlet which communicate the chamber and the closed air cavity, wherein the air inlet is disposed within the air intake region, the upper air outlet is disposed within first air supply region, and the lower air outlet is disposed within second air supply region. The first air supply region is disposed above the air intake region. The second air supply region is disposed below the first air supply region and is separated from the air intake region by the air guiding rib. The air intake region, the first air supply region and the second air supply region are configured to guide air taken in by the air inlet from the chamber such that the air flows upward along the air intake region into the first air supply region, such that a portion of the air enters the chamber via the upper air outlet, and such that another portion of the air flows down into the second air supply region and enters the chamber via the lower air outlet.

BRIEF DESCRIPTION OF THE DRAWINGS

In order to describe technical solutions in embodiments of the present disclosure more clearly, the accompanying drawings to be used in the description of disclosure will be introduced briefly. Obviously, the accompanying drawings to be described below are merely some embodiments of the present disclosure, and a person of ordinary skill in the art can obtain other drawings according to these drawings without paying any creative effort.

DETAILED DESCRIPTION

Figure 1:
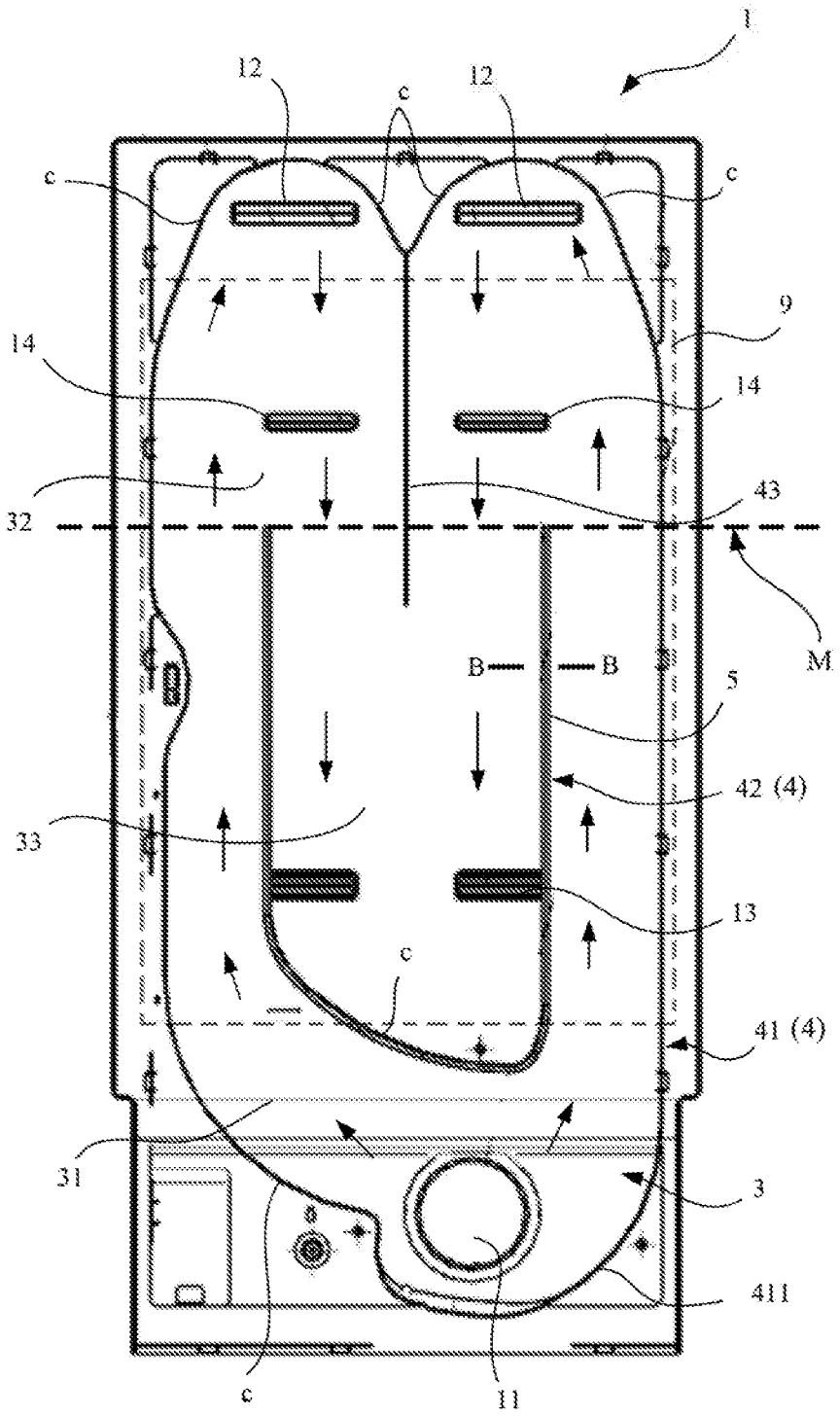
FIG. 1 is a schematic structural diagram of an air duct cover plate in a refrigerator, in accordance with some embodiments of the present disclosure (the dotted box in FIG. 3 is a region where a projection of an evaporator on the air duct cover plate is located, i.e., a region where a heat exchange occurs)

The technical solutions in embodiments of the present disclosure will be described clearly and completely with reference to the accompanying drawings in the embodiments of the present disclosure. Obviously, the described embodiments are merely some but not all of embodiments of the present disclosure. All other embodiments obtained by a person of ordinary skill in the art, based on the embodiments of the present disclosure, without paying any creative effort shall be included in the protection scope of the present disclosure.

In the description of the present disclosure, it will be understood that orientations or positional relationships indicated by terms "center", "upper", "lower", "front", "rear", "left", "right", "vertical", "horizontal", "top", "bottom", "inner", "outer", etc. are based on orientations or positional relationships shown in the drawings, which merely to facilitate and simplify the description of the present disclosure, but not to indicate or imply that the referred devices or elements must have a particular orientation, or must be constructed or operated in a particular orientation. Therefore, these terms should not be construed as limitations to the present disclosure.

Terms "first" and "second" are merely used for a purpose of description and are not to be construed as indicating or implying the relative importance or implicitly indicating the number of referred technical features. Thus, features defined with "first", "second" may explicitly or implicitly include one or more of the features. In the description of the present disclosure, the term "a plurality of" means two or more unless otherwise specified.

In the description of the present disclosure, it will be noted that terms "mounting", "connecting" and "coupling" should be understood in a broad sense unless otherwise specifically defined or limited. For example, it may be a permanent coupling, a detachable coupling, or it may be an integrated coupling. For a person of ordinary skill in the art, specific meanings of the above terms in the present disclosure may be understood according to specific circumstances.

Figure 5:
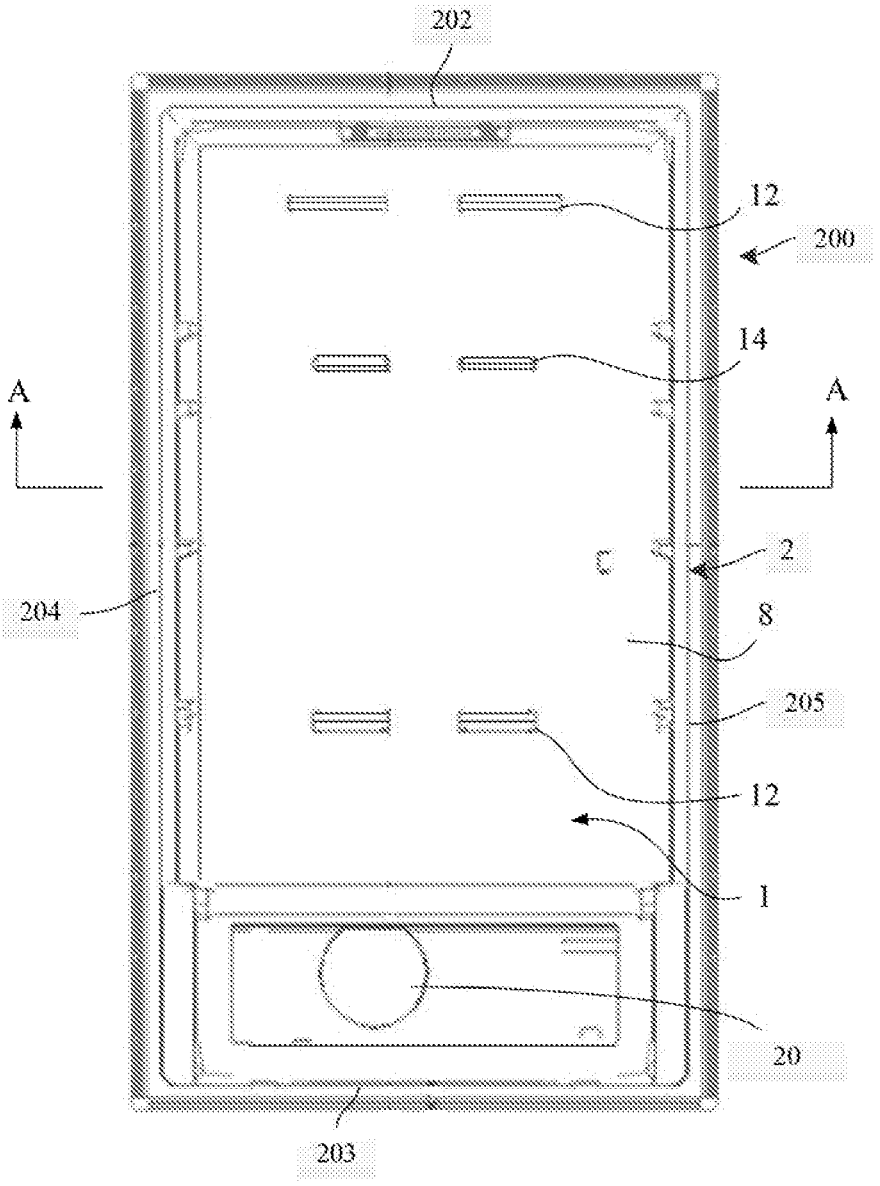
FIG. 5 is a front view of a refrigerator, in accordance with some embodiments of the present disclosure.
Figure 6:
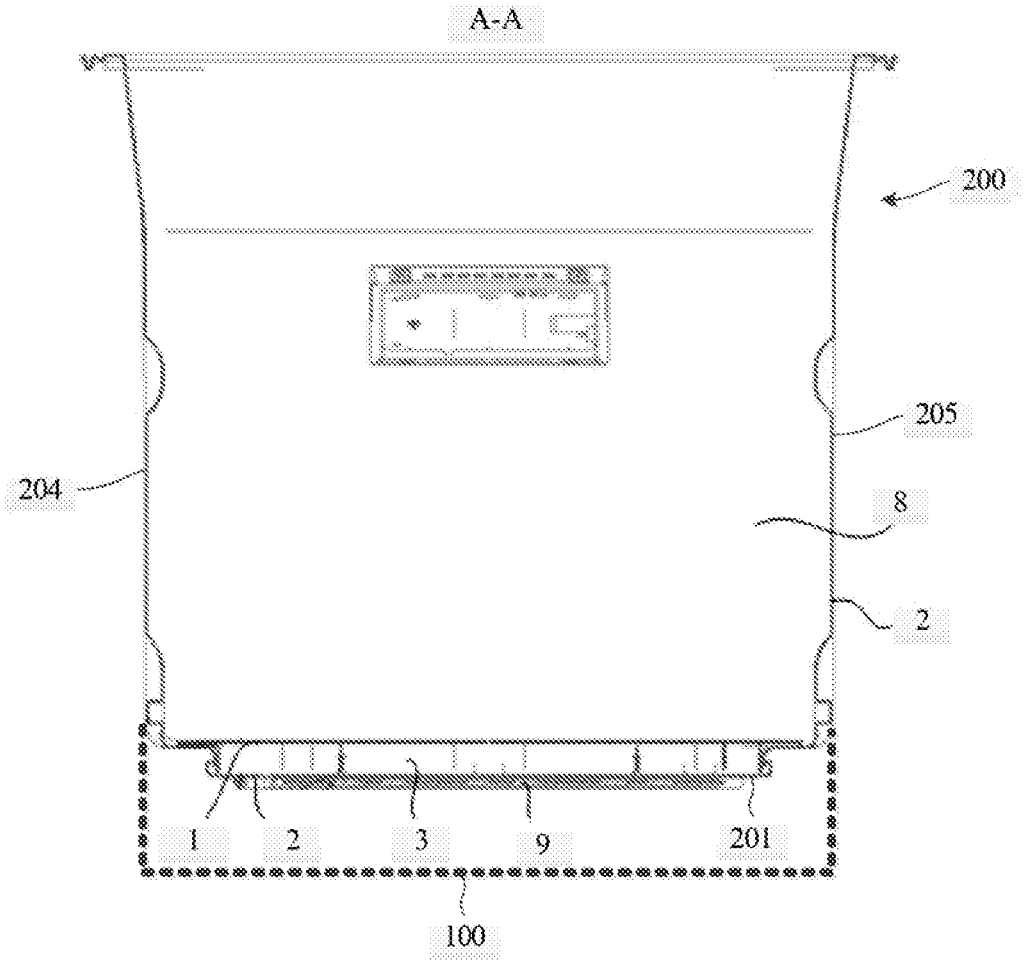
FIG. 6 is a cross-sectional view taken along the line A-A in FIG. 5.
Figure 7:
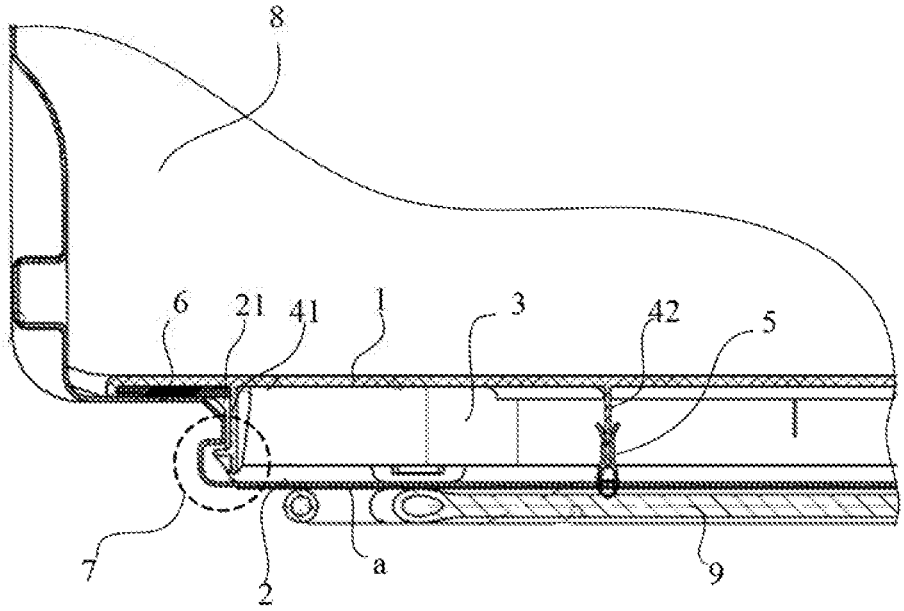
FIG. 7 is a schematic diagram of a local structure in FIG. 6.

Referring to FIGS. 1, 5 and 6, some embodiments of the present disclosure provide a refrigerator. The refrigerator includes a cabinet 200 having a chamber 8. The cabinet 8 includes a housing 100, a liner 2, an air duct cover plate 1, an air guiding rib 4, an evaporator 9, a closed air cavity 3, and an air inlet, an upper air outlet and a lower air outlet which communicate the chamber 8 and the closed air cavity 3. The closed air cavity 3 is formed at least partially between the air duct cover plate 1 and the liner 2 (as shown in FIG. 7). The air guiding rib 4 is disposed within the closed air cavity 3. The evaporator 9 is located between the liner and the housing, and an orthographic projection of the evaporator 9 on the liner 2 at least partially overlaps with an orthographic projection of the closed air cavity 3 on the liner 2. In some embodiments, the liner 2 includes a rear side wall 201, an upper side wall 202, a lower side wall 203, a left side wall 204 and a right side wall 205. The evaporator 9 is provided on an outer side surface of the rear side wall, and the closed air cavity 3 is formed between an inner side surface of the rear side wall and the air duct cover plate 1. A heat exchange between the evaporator 9 and air in the closed air cavity 3 is performed through the rear side wall. In some embodiments, a closure of the closed air cavity 3 means that positions other than an air inlet and an air outlet are closed. In some embodiments, the air duct cover plate is disposed in parallel with the inner side surface of the rear side wall. The air guiding rib 4 divides the closed air cavity 3 into an air intake region 31, a first air supply region 32 and a second air supply region 33 that are sequentially in fluid communication. The air intake region 31 includes the air inlet 11 for taking in hot air in the chamber 8. The first air supply region 32 is located above the air intake region 31, and the first air supply region 32 includes an upper air outlet 12. The second air supply region 33 is located below the first air supply region 32 and is separated from the air intake region 31 by the air guiding rib 4. And the second air supply region 33 includes a lower air outlet 13. The air inlet 11 is configured to take in the air in the chamber 8. The air taken in from the chamber 8 flows upward along the air intake region 31 and into the first air supply region 32. A portion of the air enters the chamber 8 via the upper air outlet 12, and another portion of the air flows down into the second air supply region 33, and returns the chamber 8 via the lower air outlet 13.

In some embodiments, the air intake region 31, the first air supply region 32, and the second air supply region 33 are all located in a heat exchange range of the evaporator 9 (the heat exchange range of the evaporator 9 refers to a range of a orthographic projection of the evaporator 9 on the air duct cover plate 1, for example, a region shown by the dotted box in FIG. 1). For example, the evaporator 9 may contact a surface being adjacent to the housing 100 of the liner 2, for example, the evaporator 9 abuts an outer surface of the rear side wall 201 of the liner 2 by using a double-sided tape. Such a fixed form is relatively simple, which is advantageous for reducing a cost. The outer surface of the liner 2 refers to a surface of the liner 2 located outside the closed air cavity 3 or the chamber 8, i.e., the outer side surface of the rear side wall of the liner, for example, a surface "a" in FIG. 7.

Referring to FIG. 1 and FIG. 7, in the refrigerator provided by the embodiments of the present disclosure, the closed air cavity 3 is formed at least partially between the air duct cover plate 1 and the liner 2, instead of being formed by two cover plates. In this way, the liner 2 of the cabinet is fully utilized, and a cover plate may be omitted. Thereby the number of parts of the refrigerator is reduced, a structure of the refrigerator is simpler, and further a manufacturing cost of the refrigerator air supply system is lowered. As shown in FIG. 1, the closed air cavity 3 includes the air guiding rib 4 therein, and the air guiding rib 4 divides the closed air cavity 3 into the air intake region 31, the first air supply region 32 and the second air supply region that are sequentially in fluid communication. Moreover, the evaporator 9 is located on the outer surface of rear side wall 201 of the liner 2, and an orthographic projection of the evaporator 9 on the liner 2 at least partially overlaps with an orthographic projection of the closed air cavity 3 on the liner 2. In this way, during an upward flow of hot air taken in by the air inlet 11 into the closed air cavity 3 along the air intake region 31, a heat exchange between the hot air and the evaporator 9 may be performed through the rear side wall 201 of the liner 2, so a temperature of the air is gradually lowered, and the hot air is gradually changed into cold air. After the cold air formed by virtue of the heat exchange enters the first air supply region 32, a portion of the cold air enters the chamber 8 via the upper air outlet 12, and another portion of the cold air flows downward into the second air supply region 33 (the cold air is easy to sink due to a high density), and enters the chamber 8 via the lower air outlet 13, so as to refrigerate the chamber 8. The second air supply region 33 and the air intake region 31 are separated by the air guiding rib 4, in this way, the air guiding rib 4 may not only guide the air and optimize an air flow in the closed air cavity 3, but also separate hot air before a heat exchange between the air intake region 31 and the evaporator 9 from the cold air in the second air supply region 33. Thereby, a heat exchange efficiency of the refrigerator is prevented from being affected by a heat transfer short-circuit due to a mutual movement of the hot air and the cold air.

In the refrigerator provided by the embodiments of the present disclosure, the heat exchange between the hot air and the evaporator 9 is performed after the hot air enters the closed air cavity 3; and the cold air, obtained after the heat exchange between the hot air and the evaporator 9, may directly enter the chamber 8 via the upper air outlet 12 and the lower air outlet 13. Thus, a path where the air enters the chamber 8 after the heat exchange with the evaporator 9 is greatly shortened, so that a loss of a refrigeration capacity in a case where the cold air flows may be greatly reduced, thereby contributing to improving a refrigeration effect of the refrigerator. In addition, the heat exchange between the air and the evaporator 9 may also be performed during a flow of the air to the second air supply region 33, which may further reduce the temperature of the air, thereby improving the refrigeration effect of the refrigerator.

In some embodiments of the present disclosure, as shown in FIGS. 6 and 7, the liner 2 is disposed between the housing 100 and the air duct cover plate 1, and the closed air cavity 3 is formed between the air duct cover plate 1 and an inner side wall of the liner 2. The cabinet 200 is further includes the chamber 8 therein, and the closed air cavity 3 and the chamber 8 are separated by the air duct cover plate 1. The cabinet 200 includes the upper air outlet 12, the lower air outlet 13 and the air inlet 11 disposed on the air duct cover plate 1.

In some other embodiments of the present disclosure, the air duct cover plate 1 is disposed between the housing 100 and the liner 2, and the closed air cavity 3 is formed between the air duct cover plate 1 and an outer side wall of the liner 2. The upper air outlet 12, the lower air outlet 13 and the air inlet 11 are disposed on the liner 2. In this case, the evaporator 9 for example contacts a surface being adjacent to the housing 100 of the air duct cover plate 1, and there is an insulating layer between the air duct cover plate 1 and the housing 100.

Figure 2:
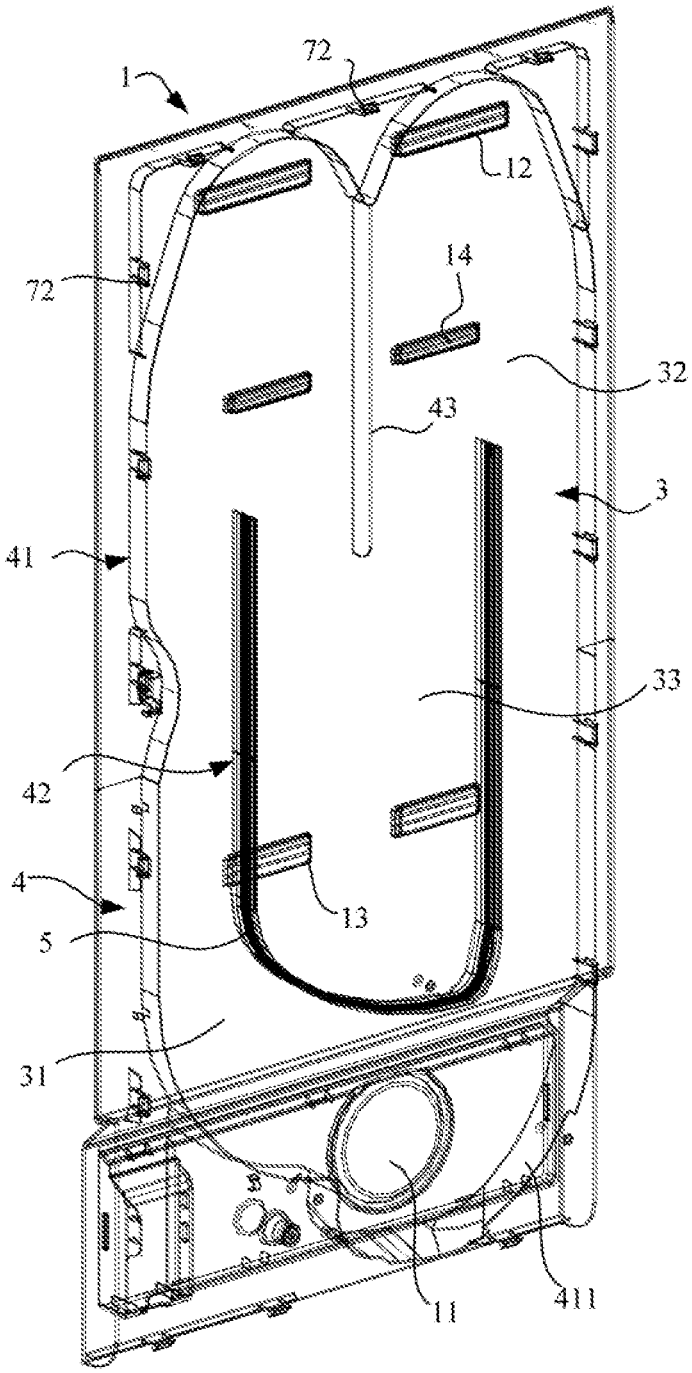
FIG. 2 is a perspective view of an air duct cover plate in a refrigerator, in accordance with some embodiments of the present disclosure.

In some embodiments of the present disclosure, as shown in FIG. 2, the air guiding rib 4 is fixed on a surface of the air duct cover plate 1 facing the liner 2. In some other embodiments of the present disclosure, the air guiding rib 4 is fixed on a surface of the liner 2 facing the air duct cover plate 1.

In the refrigerator provided by the embodiments of the present disclosure, a relative positional relationship between the second air supply region 33 and the air intake region 31 is not unique. In some embodiments of the present disclosure, the intake region 31 and the second air supply region 33 are arranged parallel in a horizontal direction, for example, the second air supply region 33 may be located on a right side of the air intake region 31, and the air taken in by the air inlet 11 may flow upward into the first air supply region 32 along the air intake region 31 on a left side of the second air supply region 33. Based on this, for example, the air inlet 11 and the lower air outlet 13 are arranged parallel in a horizontal direction, and the upper air outlet 12 is disposed above both of the air inlet 11 and the lower air outlet 13. In addition, in some other embodiments of the present disclosure, as shown in FIG. 1, the second air supply region 33 is located in the middle of the air intake region 31, so that the air taken in by the air inlet 11 may flow upward into the first air supply region 32 along the air intake region 31 both on the left and right sides of the second air supply region 33, thereby enabling the air flow in the first air supply region 32 to be more uniform. Based on this, for example, the lower air outlet 13 is disposed between the upper air outlet 12 and the air inlet 11.

A setting manner of the air guiding rib 4 is not unique, for example, it is able to design the air guiding rib 4 depending on relationships among the air intake region 31, the first air supply region 32, and the second air supply region 33. In some embodiments of the present disclosure, the air guiding rib 4 is disposed in the following manner. The air guiding rib 4 includes a second air guiding rib 42, and the second air guiding rib 42 encloses the second air supply region 33 having an open upper end and a closed lower end. The air intake region 31 is formed between the second air guiding rib 42 and the left and right side walls of the liner 2, and the first air supply region 32 is formed between the open upper end of the second air supply region 33 and the upper side wall of the liner 2.

In addition, in some other embodiments of the present disclosure, the air guiding rib 4 is disposed in the following manner. As shown in FIG. 1, the air guiding rib 4 includes a first air guiding rib 41 and a second air guiding rib 42. The first air guiding rib 41 is a closed loop, and the second air guiding rib 42 is disposed with in the first air guiding rib 41. The second air guiding rib 42 encloses the second air supply region 33 having the open upper end and the closed lower end. Taking a horizontal plan where the open upper end of the air supply region 33 is located as a reference plan M, the air intake region 31 is formed by a region between the second air guiding rib 42 and the first air guiding rib 41 which is below the reference plan M. The first air supply region 32 is formed by a region of the closed loop of the first air guiding rib 41 which is above the reference plan M. In the solution shown in FIG. 1, the first air guiding rib 41 forms a closed loop at a periphery of the air duct cover plate 1. Due to a blocking of the first air guiding rib 41, the air is not easily leaked from an assembly gap between the air duct cover plate 1 and the liner 2, thereby facilitating improving an air supply efficiency of the refrigerator (the air supply efficiency is related to parameters such as an amount of the air in the air duct that leaks and an air duct resistance. The smaller the amount of the air leaks, the higher the air supply efficiency is, and the smaller the air duct resistance is, the higher the air supply efficiency is).

After the air enters the first air supply region 32, a portion of the air will enter the chamber 8 via the upper air outlet 12, and another portion of the air will continue to flow along the first air guiding rib 41. If there is no air guiding member between the first air supply region 32 and the second air supply region 33 that may guide the air to the second air supply region 33, air flowing upward on both sides of the second air supply region 33 will move in opposite directions in an uppermost region of the closed air cavity 3, which easily causes a disturbance of an air flow in the uppermost region of the closed air cavity 3. In order to solve this problem, in some embodiments of the present disclosure, as shown in FIGS. 1 and 2, the cabinet 200 further includes a third air guiding rib 43 located in the first air supply region 32 and extending in a vertical direction. One end of the third air guiding rib 43 is coupled to the first air guiding rib 41, and another end extends into the open upper end of the second air supply region 33. Both sides of the third air guiding rib 43 are respectively provided with the upper air outlet 12. By providing the third air guiding rib 43 extending in the vertical direction in the first air supply region 32, and letting one end of the third air guiding rib 43 extend into the open upper end of the second air supply region 33, after the air flowing upward on both sides of the second air supply region 33 enters the second air supply region 33, a portion of the air enters the chamber 8 via the upper air outlet 12 on both sides of the third air guiding rib 43 respectively, and another portion of the air flows along the third air guiding rib 43 and enters the second air supply region 33. Due to a blocking of the third air guiding rib 43, the disturbance of the air flow, due to a movement of the air flowing upward on both sides of the second air supply region 33, in the opposite directions in the uppermost region of the closed air cavity 3 may be avoided, thereby a portion of the air entering the first air supply region 32 is better guided into the second air supply region 33.

In some embodiments of the present disclosure, in order to better guide air at the air inlet 11 into the air intake region 31, as shown in FIGS. 2 and 5, a fan 20 is provided at the air inlet 11. The fan 20 is configured to take in the hot air in the chamber into the closed air cavity. A portion of the first air guiding rib 41 close to the air inlet 11 forms a volute structure 411. By virtue of the volute structure 411 close to the air inlet 11, air blown out from the fan 20 in a radial direction will be smoothly guided into the air intake region 31 along the volute structure 411. In this way, a resistance against which the air blown out from the fan 20 is subjected is reduced, thereby reducing losses of an air speed and an air pressure, and further improving the air supply efficiency of the air duct of the refrigerator.

In some embodiments of the present disclosure, in order to make a distribution of cold air in an upper portion and a lower portion of the chamber 8 more uniform, as shown in FIGS. 2 and 5, a middle air outlet 14 is disposed between the upper air outlet 12 and the lower air outlet 13, and the middle air outlet 14 is located in the first air supply region 32. By adding the middle air outlet 14 between the upper air outlet 12 and the lower air outlet 13, a portion of the air entering the first air supply region 32 may enter the chamber 8 through the middle air outlet 14, so that the air may be supplied to a region between the upper air outlet 12 and the lower air outlet 13 in the chamber 8, which is advantageous for making the distribution of the cold air in the upper and lower portions of the chamber 8 more uniform. Moreover, by adding the middle air outlet 14 between the upper air outlet 12 and the lower air outlet 13, an amount of the air entering the chamber 8 may also be increased, thereby facilitating to improving the air supply efficiency of the air duct of the refrigerator. For example, as shown in FIG. 1, when the third air guiding rib 43 is disposed in the closed air cavity, two middle air outlets 14 may be provided, and the two middle air outlets 14 each is respectively located on both sides of the third air guiding rib 43.

In the refrigerator provided by the embodiments of the present disclosure, positions where the first air guiding rib 41 and the second air guiding rib 42 are fixed are not unique. For example, in some embodiments of the present disclosure, the first air guiding rib 41 and the second air guiding rib 42 are both fixed on an inner surface of the liner 2. In addition, in some other embodiments of the present disclosure, as shown in FIGS. 2 and 7, the first air guiding rib 41 and the second air guiding rib 42 are both fixed on the air duct cover plate 1. In a case where the first air guiding rib 41 and the second air guiding rib 42 are both fixed on the air duct cover plate 1, the first air guiding rib 41 and the second air guiding rib 42 may be repaired by replacing the air duct cover plate 1 if the first air guiding rib 41 or the second air guiding rib 42 are damaged, thereby contributing to reducing a maintenance cost.

Figure 3:
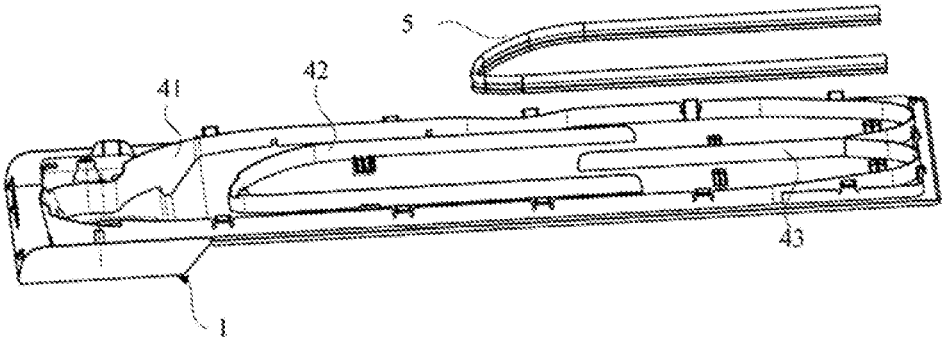
FIG. 3 is an exploded view of an air duct cover plate and a first sealing member in a refrigerator, in accordance with some embodiments of the present disclosure.

Referring to FIG. 2 and FIG. 3, in some embodiments of the present disclosure, the cabinet 200 further includes a first sealing member 5. In a case where the first air guiding rib 41 and the second air guiding rib 42 are both fixed on the air duct cover plate 1, a side of the second air guiding rib 42 that is spaced from the air duct cover plate 1 is sealed with the liner 2 via a first sealing member 5. Since the first sealing member 5 is disposed between the side of the second air guiding rib 42 away from the air duct cover plate 1 and the liner 2, air on left and right sides of the second air guiding rib 42 is difficult to move through an assembly gap between the second air guiding rib 42 and the liner 2. Therefore, the second air guiding rib 42 better separates the hot air in the air intake region 31 from the cold air in the second air supply region 33, which avoiding a heat exchange between the hot air and the cold air on the left and right sides of the second air guiding rib 42, and further improving the refrigeration effect of the refrigerator.

Figure 4:
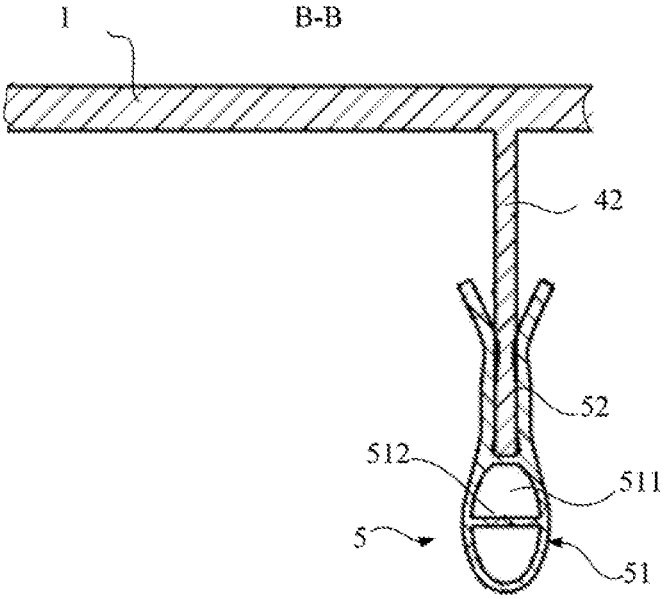
FIG. 4 is a cross-sectional view taken along the line B-B in FIG. 1.

A structure of the first sealing member 5 is not unique. For example, the first sealing member 5 may be a gasket. The gasket is fixed on a region of the liner 2 opposite to the second air supply region 33, and the side of the second air guiding rib 42 away from the air duct cover plate 1 is attached to the gasket. In addition, in some embodiments of the present disclosure, the gasket may also have the following structure. As shown in FIG. 4, the first sealing member 5 includes an elastic sealing strip 51 and a first clamping groove 52 formed on a side of the elastic sealing strip 51. The first clamping groove 52 is snap-fitted with the second air guiding rib 42, and the elastic sealing strip 51 abuts against the liner 2. For example, the first clamping groove 52 is located on a side of the elastic sealing strip 51, the side being adjacent to the second air guiding rib. In the solution shown in FIG. 4, the first sealing member 5 occupies a small volume and is convenient to install. Moreover, the elastic sealing strip 51 abuts the liner 2, which may make a sealing between the second air guiding rib 42 and the liner 2 better.

A structure of the elastic sealing strip 51 is also not unique. For example, in some embodiments of the present disclosure, the elastic sealing strip 51 is solid. In addition, in some other embodiments of the present disclosure, as shown in FIG. 4, an air cavity 511 is formed in the elastic sealing strip 51. In a solution in which the air cavity 511 is formed in the elastic sealing strip 51, an elasticity of the elastic sealing strip 51 is better. When the elastic sealing strip 51 is abuts the liner 2, the air cavity 511 may be greatly deformed, so that the elastic sealing strip 51 is tightly attached to the liner 2, thereby further improving a sealing effect of the first sealing member 5.

The first sealing member 5 may be made of a plurality of materials, such as rubber, plastic and sponge. In order to make the first sealing member 5 have a better sealing effect, the first sealing member 5 may be coextruded from thermoplastic elastomer (TPE) and polyvinyl chloride (PVC). The elastic sealing strip 51 having the air cavity 511 is made of the TPE, and the first clamping groove 52 formed on a side in a radial direction of the elastic sealing strip 51 is made of the PVC. Since the TPE has a soft texture, a high elasticity, and a good temperature resistance (that is, performances of the TPE do not change at different temperatures), a sealing effect of the elastic sealing strip 51 may be improved to a greater extent if the elastic sealing strip 51 having the air cavity 511 is made of the TPE. Since a hardness of the PVC is high, a snap-fit connection between the first clamping groove 52 and the second air guiding rib 42 being more secure may be ensured if the first clamping groove 52 is made of the PVC.

In embodiments in which the air cavity 511 is formed in the elastic sealing strip 51, a structure of the air cavity 511 is not unique. For example, in some embodiments of the present disclosure, there is no elastic dividing rib in the air cavity 511, and only one air cavity is provided in the elastic sealing strip 51. In addition, in some other embodiments of the present disclosure, as shown in FIG. 4, the air cavity 511 includes an elastic dividing rib 512 therein. The elastic dividing rib 512 divides the air cavity 511 into two sub-cavities, which may increase a strength of the elastic sealing strip 51, thereby causing the elastic sealing strip 51 not to be easily damaged.

A setting manner of the elastic dividing rib 512 in the air cavity 511 is also not unique. For example, in some embodiments of the present disclosure, the elastic dividing rib 512 may be disposed in parallel with the second air guiding rib 42, that is, the elastic dividing rib 512 is parallel to a snap-fit direction of the first clamping groove 52. Moreover, in some other embodiments of the present disclosure, as shown in FIG. 4, the elastic dividing rib 512 is disposed perpendicular to the second air guiding rib 42. That is, the elastic dividing rib 512 is disposed perpendicular to a snap-fit direction of the elastic sealing strip 51. In some embodiments, the mounting direction of the elastic sealing strip is perpendicular to the air duct cover plate. In a case where the elastic dividing rib 512 is disposed perpendicular to the mounting direction of the elastic sealing strip 51, since the elastic dividing rib 512 is parallel to a surface of the liner 2, the air cavity 511 will not be supported by the elastic dividing rib 512 in a direction perpendicular to the surface of the liner 2 when the elastic sealing strip 51 abuts the liner 2. Therefore, an attachment area between the air cavity 511 and the liner 2 may be large, and further the sealing effect of the elastic sealing strip 51 may be improved.

In the refrigerator provided by the embodiments of the present disclosure, a manner in which the air duct cover plate 1 is coupled to the liner 2 of the refrigerator is not unique. For example, in some embodiments of the present disclosure, an edge of the surface of the air duct cover plate 1 facing the liner and the liner 2 of the refrigerator are coupled through screws and are sealed through a second sealing member 6. The second sealing member 6 is located outside the first air guiding rib 41.

In addition, in some other embodiments of the present disclosure, as shown in FIG. 6 and FIG. 7, the edge of the surface of the air duct cover plate 1 facing the liner and the liner 2 are snap-fitted through a clamping structure 7, and are sealed through the second sealing member 6. The second sealing member 6 may prevent the air in the closed air cavity 3 from leaking into the chamber 8, and may prevent a heat exchange between the hot air in the closed air cavity 3 and the cold air in the chamber 8, thereby contributing to improving the refrigeration effect of the refrigerator. A snap-fit connection through the clamping structure 7 makes it easier to disassemble and assemble the air duct cover plate 1 and the liner 2 of the refrigerator, thereby facilitating a maintenance and a replacement of the air duct cover plate 1.

A structure of the second sealing member 6 is also not unique. For example, in some embodiments of the present disclosure, the second sealing member 6 includes a plurality of strip-shaped sealing strips. The plurality of strip-shaped sealing strips are disposed between an edge of the air duct cover plate 1 and the liner 2 of the refrigerator, and the plurality of strip-shaped sealing strips are arranged end to end around the edge of the air duct cover plate 1. In addition, in some other embodiments of the present disclosure, as shown in FIGS. 6 and 7, the second sealing member 6 includes an annular sealing strip disposed between the edge of the air duct cover plate 1 and the liner 2 of the refrigerator, and the annular sealing strip is disposed around the edge of the air duct cover plate 1. The annular sealing member 6 is located outside the first air guiding rib 41. In a solution in which the second sealing member 6 is an annular sealing strip, since the annular sealing strip is a whole, a sealing effect between the edge of the air duct cover plate 1 and the liner 2 of the refrigerator may be better, and an installation of the second sealing member 6 may also be more convenient and quick.

The annular sealing strip (the second sealing member 6) may be disposed around the outside of the first air guiding rib 41 (as shown in FIG. 7), or may be directly disposed on the first air guiding rib 41. For example, the annular sealing strip may be designed to have the structure of the first sealing member 5 shown in FIG. 4. That is, the annular sealing strip includes an elastic sealing strip and a clamping groove formed on a side in a radial direction of the elastic sealing strip. The clamping groove may be snap-fitted with the first air guiding rib 41, and the elastic sealing strip may abut against the liner.

In some embodiments of the present disclosure, the annular sealing strip is disposed around the outside of the first air guiding rib 41 (as shown in FIG. 7), and the annular sealing strip may be made of sponge. In a case where the first air guiding rib 41 may block the cold air in the closed air cavity 3 reaching the annular sealing strip, the annular sealing strip being made of the sponge may also meet sealing requirements because the sponge is not prone to a contraction due to an encounter with the cold air.

Figure 8:
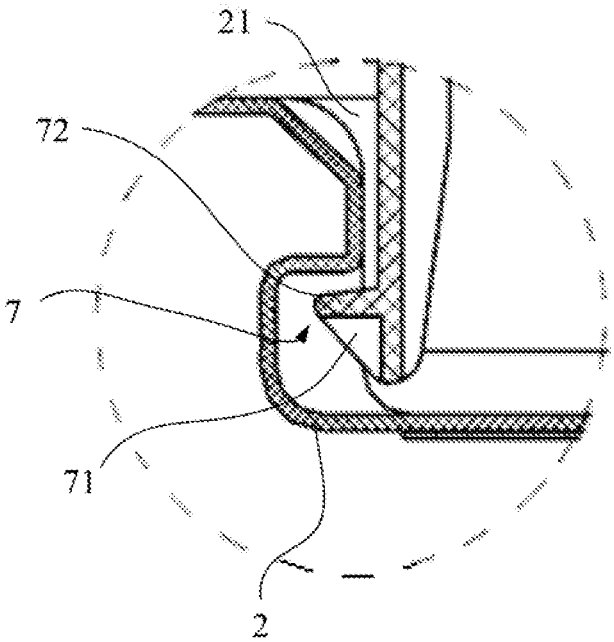
FIG. 8 is an enlarged view of a local structure of a clamping structure in FIG. 7.

Referring to FIG. 7, in some embodiments of the present disclosure, a concave cavity 21 is formed in the liner 2, and the air duct cover plate 1 is disposed at an opening of the concave cavity 21. The clamping structure 7 is not unique. For example, in some embodiments of the present disclosure, the clamping structure 7 includes a plurality of second clamping grooves spaced around the edge of the air duct cover plate 1 and a plurality of clamping hooks disposed on a side wall of the concave cavity 21. The second clamping grooves snap with corresponding clamping hooks. In addition, in some embodiments of the present disclosure, as shown in FIGS. 7 and 8, the clamping structure 7 includes a second clamping groove 71 disposed on the side wall of the concave cavity 21, and a plurality of clamping hooks 72 spaced around the edge of the air duct cover plate 1. The second clamping groove 71 snaps with the plurality of clamping hooks 72. A solution in which the clamping hooks 72 are disposed on the air duct cover plate 1 and the second clamping groove 71 is disposed on the side wall of the concave cavity 21 may cause a snap-fit connection between the air duct cover plate 1 and the concave cavity 21 to be more secure, and also may avoid a decrease of a strength of the air duct cover plate due to a grooving on the air duct cover plate 1.

In some embodiments of the present disclosure, the annular sealing strip (the second sealing member 6) is disposed around the outside of the first air guiding rib 41. As shown in FIG. 2, some clamping hooks 72 are disposed on the air duct cover plate 1, and some clamping hooks 72 are disposed on the first air guiding rib 41, which may be specifically determined according to the space for the clamping hooks 72. In some embodiments of the present disclosure, the annular sealing strip is directly disposed on the first air guiding rib 41, and the plurality of clamping hooks 72 are all disposed on the air duct cover plate 1.

In the refrigerator provided by the embodiments of the present disclosure, structures of bent portions of the first air guiding rib 41 and the second air guiding rib 42 both are not unique. For example, the bent portions of the first air guiding rib 41 and the second air guiding rib 42 both may be at right angles. In addition, as shown in FIG. 1, structures of the bent portions of the first air guiding rib 41 and the second air guiding rib 42 both may also be curved surfaces (i.e., the curved surface c in FIG. 1). The surfaces of the bent portions of the first air guiding rib 41 and the second air guiding rib 42 being curved may greatly reduce losses of an air speed and an air pressure at the bent portions of the first air guiding rib 41 and the second air guiding rib 42, thereby contributing to improving the air supply efficiency of the air duct of the refrigerator.

In the description of the embodiments described above, features, structures, materials or characteristics may be combined in any suitable manner in any one or more embodiments or examples.

The foregoing descriptions are merely some specific implementation manners of the present disclosure, but the protection scope of the present disclosure is not limited thereto, and the changes or replacements that any person skilled in the art can easily think of in the technical scope disclosed by the present disclosure should be within the protection scope of the present disclosure. Therefore, the protection scope of the present disclosure shall be subjected to the protection scope of the claims.

What is claimed is:

1. A refrigerator, comprising:

a cabinet including a chamber, wherein the cabinet includes:

a housing, a liner, and an air duct cover plate; wherein the air duct cover plate is disposed between the housing and the liner;

a closed air cavity formed at least partially between the air duct cover plate and the liner; wherein the closed air cavity and the chamber are separated by the liner;

an evaporator disposed between the liner and the housing, and wherein an orthographic projection of the evaporator on the liner at least partially overlaps with an orthographic projection of the closed air cavity on the liner; and an air guiding rib, wherein the air guiding rib is disposed in the closed air cavity, and wherein the air guiding rib is configured to divide the closed air cavity into an air intake region, a first air supply region, and a second air supply region that are sequentially in fluid communication;

an air inlet, an upper air outlet and a lower air outlet which communicate the chamber and the closed air cavity, wherein the air inlet is disposed within the air intake region, the upper air outlet is disposed within first air supply region, and the lower air outlet is disposed within second air supply region; and the air inlet, the upper air outlet and the lower air outlet are disposed in the liner;

wherein the first air supply region is disposed above the air intake region, the second air supply region is disposed below the first air supply region and is separated from the air intake region by the air guiding rib;

wherein the air intake region, the first air supply region, and the second air supply region are configured to guide air taken in by the air inlet from the chamber such that the air flows upward along the air intake region and into the first air supply region, such that a portion of the air enters the chamber via the upper air outlet, and such that another portion of the air flows down into the second air supply region and enters the chamber via the lower air outlet.

2. The refrigerator according to claim 1, wherein the intake region, the first air supply region, and the second air supply region meet at least one of relationships:

the second air supply region is disposed between the intake region and the first air supply region;

the intake region is disposed between the first air supply region and the second air supply region; or, the intake region and the second air supply region are arranged parallel in a horizontal direction, and the first air supply region is disposed above both of the intake region and the second air supply region;

wherein the air inlet, the upper air outlet and the lower air outlet meet at least one of relationships:

the lower air outlet is disposed between the upper air outlet and the air inlet;

the air inlet is disposed between the upper air outlet and the lower air outlet;

the air inlet and the lower air outlet are arranged parallel in a horizontal direction, and the upper air outlet is disposed above both of the air inlet and the lower air outlet.

3. The refrigerator according to claim 1, wherein the air guiding rib includes:

a first air guiding rib, wherein the first air guiding rib is a closed loop; and a second air guiding rib, wherein the second air guiding rib is disposed in the closed loop of the first air guiding rib and encloses the second air supply region having an open upper end and a closed lower end, when taking a horizontal plan where the open upper end of the air supply region is located as a reference plan, wherein the air intake region is formed by a region between the second air guiding rib and the first air guiding rib which is below the reference plan, and wherein the first air supply region is formed by a region of the closed loop of the first air guiding rib which is above the reference plan.

4. The refrigerator according to claim 3, wherein the cabinet further includes a third air guiding rib, wherein the third air guiding rib is disposed in the first air supply region and extends in a vertical direction such that one end of the third air guiding rib is coupled to the first air guiding rib, such that a different end of the third air guiding rib extends into the open upper end of the second air supply region, and such that both sides of the third air guiding rib are respectively provided with the upper air outlet.

5. The refrigerator according to claim 3, wherein a fan is located adjacent to the air inlet, and wherein a portion of the first air guiding rib close to the air inlet forms a volute structure.

6. The refrigerator according to claim 3, wherein the cabinet further includes a first sealing member;

wherein the first air guiding rib and the second air guiding rib are both fixed on the air duct cover plate, and wherein a side of the second air guiding rib that is spaced from the air duct cover plate is sealed with the liner via the first sealing member.

7. The refrigerator according to claim 6, wherein the first sealing member includes:

an elastic sealing strip, wherein the elastic sealing strip abuts the liner; and a first clamping groove, which is formed on a side of the elastic sealing strip being adjacent to the second air guiding rib, wherein the first clamping groove is snap-fitted with the second air guiding rib.

8. The refrigerator according to claim 7, wherein an air cavity is formed in the elastic sealing strip.

9. The refrigerator according to claim 8, wherein the first sealing member further includes:

an elastic dividing rib, wherein the elastic dividing rib is disposed within the air cavity; and wherein the elastic dividing rib divides the air cavity into two sub-cavities.

10. The refrigerator according to claim 9, wherein the elastic dividing rib is perpendicular to a snap-fit direction of the first clamping groove; or the elastic dividing rib is parallel to a snap-fit direction of the first clamping groove.

11. The refrigerator according to claim 3, wherein the cabinet further includes:

a clamping structure, wherein an edge of a surface of the air duct cover plate facing the liner is snap-fitted with the liner through the clamping structure; and a second sealing member, wherein the edge of the surface of the air duct cover plate facing the liner is sealed with the liner by the second sealing member.

12. The refrigerator according to claim 11, wherein a concave cavity is formed in the liner and the air duct cover plate is configured to cover an opening of the concave cavity;

wherein the clamping structure includes:

at least one second clamping groove, which is disposed on a side wall of the concave cavity, and the at least one second clamping groove is arranged around the opening of the concave cavity; and a plurality of clamping hooks, which are disposed at an edge of the air duct cover plate, wherein the plurality of clamping hooks are spaced around the edge of the air duct cover plate; and wherein the at least one second clamping groove is snap-fitted with the plurality of clamping hooks.

13. The refrigerator according to claim 12, wherein the plurality of clamping hooks are disposed on a surface of the air duct cover plate close to the concave cavity and located at an outside of the first air guiding rib, or the plurality of clamping hooks are disposed on the first air guiding rib.

14. The refrigerator according to claim 11, wherein the second sealing member includes at least one of:

an annular sealing strip, which is disposed between an edge of the air duct cover plate and the liner, and the annular sealing strip is disposed around the edge of the air duct cover plate; or a plurality of sealing strips, which are disposed between an edge of the air duct cover plate and the liner, and the plurality of annular sealing strips are disposed around the edge of the air duct cover plate in an end to end way.

15. The refrigerator according to claim 3, wherein at least one surface of at least one bent portion of at least one of the first air guiding rib and the second air guiding rib is curved.

16. The refrigerator according to claim 1, wherein the cabinet further includes a middle air outlet, wherein the lower air outlet is disposed between the upper air outlet and the air inlet, and the middle air outlet is disposed between the upper air outlet and the lower air outlet, and wherein the middle air outlet is disposed in the first air supply region.

17. The refrigerator according to claim 1, wherein the air intake region, the first air supply region, and the second air supply region are all located in a range of a projection of the evaporator on the air duct cover plate.

18. The refrigerator according to claim 1, wherein the evaporator contacts a surface of the liner, the surface being adjacent to the housing; or the evaporator contacts a surface of the air duct cover plate, the surface being adjacent to the housing.

* * * * *